United States Patent [19]

Miller

[11] Patent Number: 4,830,235

[45] Date of Patent: May 16, 1989

[54] SIPHON TUBE APPARATUS

[76] Inventor: Michael D. Miller, 1148 Titus Ave., Titusville, Fla. 32796

[21] Appl. No.: 150,918

[22] Filed: Feb. 1, 1988

[51] Int. Cl.[4] ..... B67D 5/60

[52] U.S. Cl. ..... 222/464; 222/481.5; 138/121

[58] Field of Search ..... 222/416, 464, 481.5, 222/382; 138/120–121, 103, 118

[56] References Cited

U.S. PATENT DOCUMENTS

| | | | |
|---|---|---|---|
| 2,483,661 | 10/1949 | Neas | 222/464 X |
| 2,530,583 | 11/1950 | Nurkiewicz | 222/464 X |
| 2,569,975 | 10/1951 | Cone | 222/464 X |
| 2,950,031 | 8/1960 | Abplanalp et al. | 222/464 X |
| 3,847,184 | 11/1974 | God | 138/120 |
| 4,069,950 | 1/1978 | Archer | 222/210 |
| 4,273,272 | 6/1981 | Blanc | 222/464 |
| 4,662,404 | 5/1987 | LeVeen et al. | 138/120 |

FOREIGN PATENT DOCUMENTS

| | | | |
|---|---|---|---|
| 2031526 | 4/1980 | United Kingdom | 222/464 |

*Primary Examiner*—Michael S. Huppert
*Attorney, Agent, or Firm*—Leon Gilden

[57] ABSTRACT

A siphon tube apparatus is set forth wherein an articulated jointed siphon tube is utilized in conjunction with conventional spary head and a reservoir bottle formed with a weighted pickup end formed with positioning legs to bias the pickup end of the articulated tube to the remote portions of the reservoir bottle to enable a more complete withdrawal and efficient use of fluid within said bottle.

1 Claim, 1 Drawing Sheet

10
11
12
13
14
15
16
17
18
19
20
20a
21
22
23
5

SIPHON TUBE APPARATUS

BACKGROUND OF THE INVENTION

1. Field of the Invention

The field of invention relates to spray apparatus and more particularly pertains to a new and improved siphon tube for utilization with a conventional spray head in association with a reservoir bottle to effect a more complete removal of fluid within said bottle.

2. Description of the Prior Art

The use of spray apparatus and siphon tubes associated therewith is well known in the prior art. As may be appreciated, these devices are normally formed of a single rigid siphon tube extending into the reservoir bottle wherein a quantity of fluid remaining in said bottle is either lost, due to inability of the siphon tube to effect removal of the fluid or else an associated spray head must be removed from the bottle and thereby prevent spraying of the fluid through the spray head in an attempt to withdraw the remaining fluid. Various siphon tubes and organizations therefore have been developed by the prior art to attempt to effectively withdraw fluids from a reservoir bottle. For example, U.S. Pat. No. 236,671 to Cochrane utilizes a plurality of spaced reservoir bottles with a siphon tube associated therebetween to enable removal of amounts of fluid from a larger reservoir bottle into a smaller. The Cochrane patent is of interest relative to a siphon tube arrangement to enable utilization of fluid within a reservoir bottle, but is of a structural organization relatively remote from the instant invention.

U.S. Pat. No. 442,696 to Thompson utilizes a siphon for storage containers setting forth the use of a flexible siphon tube with an associated spring operatable to close an associated valve and lift a tube to enable withdrawal of fluid within the storage container and is of interest only as an early effort to utilize fluid efficiently as stored within a storage tank or vessel.

U.S. Pat. No. 3,558,020 to Russel utilizes a pivotal tube directed from a storage container wherein the hose is secured within a tube in said container to enable effective siphoning of fluid within said container.

U.S. Pat. No. 4,099,527 to Howell sets forth a relatively complex siphoning organization including a flow regulator associated with a normally open-ended overflow tube wherein the siphoning action may be primed to initiate fluid flow in a controlled amount through a longer leg of the siphon in an effective and efficient manner. The Howell patent is of interest relative to response to a need for a more efficient removal of fluid within a container, but is a relatively more complex and elaborate organization than the instant invention.

U.S. Pat. No. 4,318,421 to Ward wherein a coupling arrangement is set forth in cooperation with a siphon tube where, as in other prior devices, the organization is of a relatively more complex and remote response to a problem than the instant invention.

As such, it may be appreciated that there is a continuing need for a new and improved siphon tube apparatus which addresses both the problem of effectiveness and simplicity, and in this respect, the present invention substantially fulfills this need.

SUMMARY OF THE INVENTION

In view of the foregoing disadvantages inherent in the known types of siphon tube apparatus now present in the prior art, the present invention provides an siphon tube apparatus wherein the same may be compactly and efficiently positioned within a reservoir bottle and may be further easily and effectively utilized to effect removal of fluid within said bottle. A weighted end of the siphon tube apparatus enables biasing of the terminal end of the pickup tube to remaining fluid within the bottle. As such, the general purpose of the present invention, which will be described subsequently in greater detail, is to provide a new and improved siphon tube apparatus which has all the advantages of the prior art siphon tube apparatus and none of the disadvantages.

To attain this, the present invention comprises an elongate, articulated jointed tube associated with a conventional manually manipulatable spray head wherein a plurality of joints interconnecting a plurality of siphon tube sections has formed a terminal end of a lowermost section a weighted pickup end to bias the pickup end towards limited fluid remaining with the reservoir bottle. The various sections of tubing may be formed of relatively rigid plastic but desirably, the terminal or last pickup tube securing the pickup end is formed of a pliable material to enable positioning of the pickup end in the remote portions of the reservoir bottle.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved siphon tube apparatus which has all the advantages of the prior art siphon tube apparatus and none of the disadvantages.

It is another object of the present invention to provide a new and improved siphon tube apparatus which may be easily and efficiently manufactured and marketed.

It is a further object of the present invention to provide a new and improved siphon tube apparatus which is of a durable and reliable construction.

An even further object of the present invention is to provide a new and improved siphon tube apparatus which is susceptible of a low cost of manufacture with regard to both materials and labor, and which accordingly is then susceptible of low prices of sale to the consuming public, thereby making such siphon tube apparatus economically available to the buying public.

Still yet another object of the present invention is to provide a new and improved siphon tube apparatus which provides in the apparatuses and methods of the prior art some of the advantages thereof, while simultaneously overcoming some of the disadvantages normally associated therewith.

Still another object of the present invention is to provide a new and improved siphon tube apparatus wherein an elongate, articulated jointed pickup tube is formed of a plurality of jointed tube portions.

Yet another object of the present invention is to provide a new and improved siphon tube apparatus wherein a weighted hemispherical pickup end is formed as a terminal end of the pickup tube sections to bias the pickup end towards the remaining fluid within a reservoir bottle.

Even still another object of the present invention is to provide a new and improved siphon tube apparatus wherein a plurality of positioning legs are formed on the face of the weighted pickup end to position the pickup end a distance above the interior surface of the bottle to prevent stoppage of flow to the weighted pickup end.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figures 1, 2, 3, 4, 5:
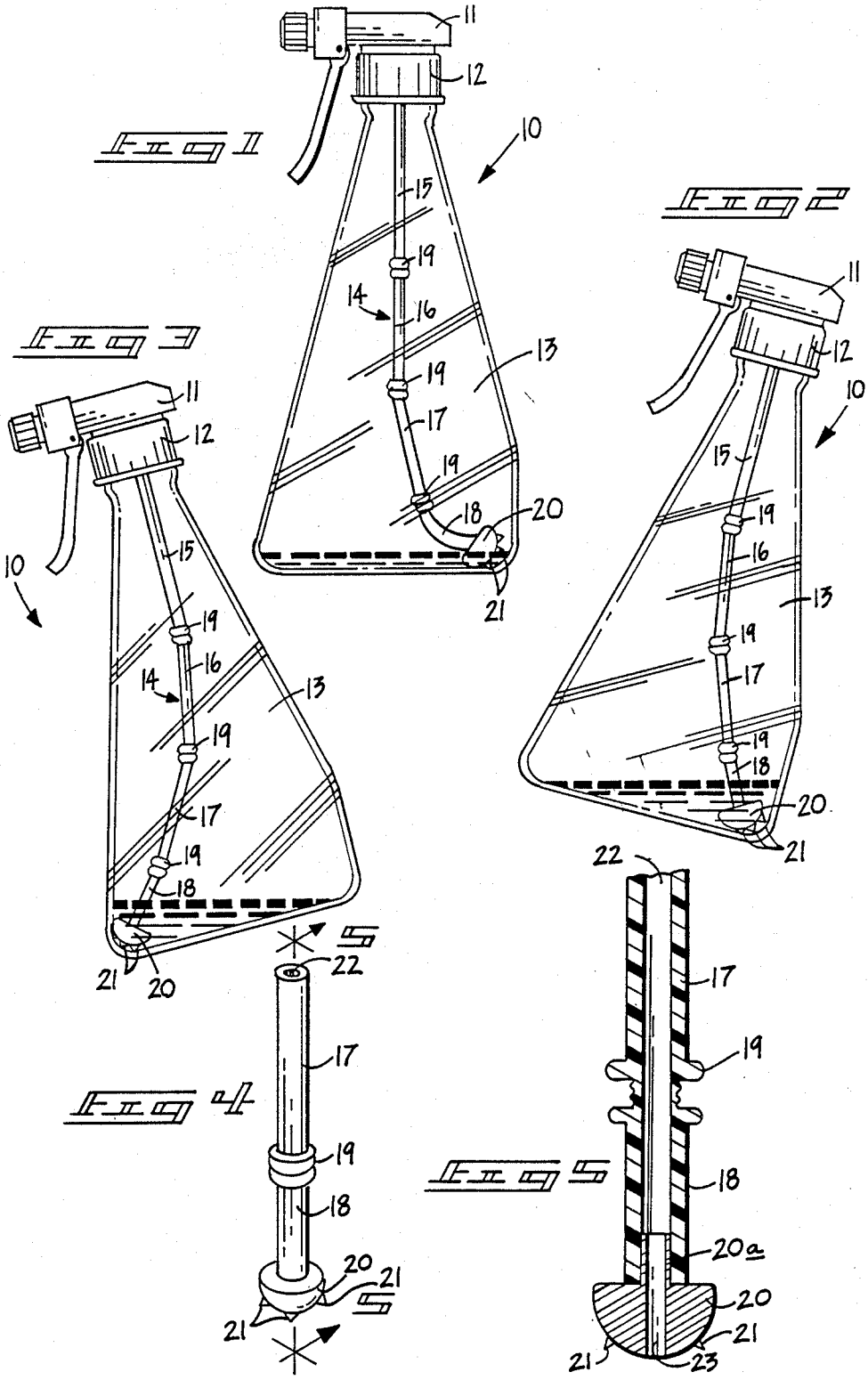
FIG. 1 is an orthographic side view taken in elevation of the instant invention.
FIG. 2 is an orthographic side view taken in elevation of the instant invention illustrating the rearwardmost positioning of the weighted pickup end.
FIG. 3 is an orthographic side view taken in elevation of the instant invention illustrating a forwardmost orientation of the weighted pickup end.
FIG. 4 is an isometric fragmentary illustration of a lowermost portion of the articulated tube portion.
FIG. 5 is an orthographic view taken along the lines 5—5 of FIG. 4 in the direction indicated by the arrows.

With reference now to the drawings, and in particular to FIGS. 1 to 5 thereof, a new and improved siphon tube apparatus embodying the principles and concepts of the present invention and generally designated by the reference numeral 10 will be described.

More specifically, it will be noted that the siphon tube apparatus 10 essentially comprises a conventional spray head 11 formed with a threaded cap securable to a complementarily threaded reservoir bottle 13. An articulated jointed siphon tube 14 is secured to the spray head 11 to effect a supply of fluid through said siphon tube to the associated spray head.

The articulated siphon tube 14 is formed of a plurality of tubular sections indicated as first tubular section 15, second tubular section 16, third tubular section 17, and fourth tubular section 18. The so noted tubular sections are secured by a plurality of pivotal joints 19 to enable a wide range of articulated motion between the various tubular sections. It is desirable that the tubular sections 15, 16 and 17 be formed of relatively rigid extruded-type plastics or equivalent material with the fourth tubular section 14 formed of a relatively flexible plastic-like material. The various tubular sections 15, 16, 17, and 18 may all be formed of flexible material but it is found that the use of the combination of rigid materials through the first three sections 15, 16, and 17, respectively, of tubular sections be formed of rigid material.

A weighted hemispherical-like pickup end 20 is secured to the terminal end of the fourth tubular section 18 by an associated interference fit with an extension tube integrally formed to the weighted hemispherical pickup end 20. The pickup end 20 may be formed of a metallic-like material or of a relatively dense plastic-like material but must be of sufficient weight to enable biasing of the articulated jointed siphon tube 14 to the remote portions of the reservoir bottle, as illustrated in FIGS. 1, 2, and 3. The pickup end 20 is also formed with at least three positioning legs 21 extending therefrom to enable positioning of the pickup conduit 23 a distance spaced above a surface of the interior of reservoir bottle 13 to prevent stoppage of flow therethrough. The remaining tubular sections 15, 16, 17, and 18 form a common conduit 22 providing a flow of fluid to the associated spray head 11.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A siphon tube apparatus for use in combination with a spray head wherein said spray head is removably securable to a reservoir bottle, said apparatus comprising, an articulated siphon tube means secured to said spray head positioned within said bottle for directing fluid contained within said reservoir bottle to said spray head;

a pickup end means secured to a terminal end of said siphon tube means remote from said spray head to bias said terminal end and pickup end means to remote portions of said reservoir bottle by action of gravity on said pickup end means, wherein said siphon tube means is formed with a plurality of rigid section tubes interconnected by pivotal joints, wherein said plurality of section tubes comprises at least two rigid section tubes interconnected by a joint with an uppermost section tube secured to said spray head and a lowermost terminal section tube secured to said pick-up end means, and wherein said pickup end means includes a convex hemispherical surface and a plurality of positioning legs integrally secured to said convex hemispherical surface to position said hemispherical surface a distance above an interior surface of said reservoir bottle, and wherein said lowermost section tube is formed of flexible plastic-like material.

* * * * *